US011957242B2

(12) United States Patent
Brown et al.

(10) Patent No.: US 11,957,242 B2
(45) Date of Patent: Apr. 16, 2024

(54) HEIGHT ADJUSTING AND LEVELING WORKSURFACE CANTILEVER

(71) Applicant: DIRTT ENVIRONMENTAL SOLUTIONS LTD., Calgary (CA)

(72) Inventors: Thomas A. Brown, Calgary (CA); Geoff W. Gosling, Calgary (CA); Joseph A. Vulic, Calgary (CA)

(73) Assignee: DIRTT ENVIRONMENTAL SOLUTIONS LTD., Calgary (CA)

( * ) Notice: Subject to any disclaimer, the term of this patent is extended or adjusted under 35 U.S.C. 154(b) by 0 days.

(21) Appl. No.: 17/423,531

(22) PCT Filed: Mar. 20, 2020

(86) PCT No.: PCT/US2020/023935
§ 371 (c)(1),
(2) Date: Jul. 16, 2021

(87) PCT Pub. No.: WO2020/191324
PCT Pub. Date: Sep. 24, 2020

(65) Prior Publication Data

US 2022/0071387 A1 Mar. 10, 2022

Related U.S. Application Data

(60) Provisional application No. 62/821,403, filed on Mar. 20, 2019.

(51) Int. Cl.
*A47B 5/02* (2006.01)
*A47B 9/04* (2006.01)
*A47B 83/00* (2006.01)

(52) U.S. Cl.
CPC ..... *A47B 5/02* (2013.01); *A47B 9/04* (2013.01); *A47B 2083/005* (2013.01)

(58) Field of Classification Search
CPC ..... A47B 5/02; A47B 9/04; A47B 2083/005
(Continued)

(56) References Cited

U.S. PATENT DOCUMENTS 1,915,802 A * 6/1933 Roshnell ..... F16M 11/10 108/147
2,650,387 A 9/1953 Foss
(Continued)

FOREIGN PATENT DOCUMENTS

AU 06291/00 B2 9/1992
CA 2840843 A1 12/2013
(Continued)

OTHER PUBLICATIONS

European Search Report and Search Opinion Received for EP Application No. 13800179.7, dated Feb. 2, 2016, 9 pages.
(Continued)

*Primary Examiner* — Daniel J Troy
*Assistant Examiner* — Timothy M Ayres
(74) *Attorney, Agent, or Firm* — Workman Nydegger

(57) ABSTRACT

A height adjusting and leveling worksurface cantilever can comprise a leveling mechanism comprising a turnbuckle rod that can adjust an angle of a horizontal frame member relative to a vertical frame member. An assembler can adjust the angle of the horizontal frame member from a pivot point located on a proximal corner of the height adjusting and leveling worksurface cantilever. The height adjusting and leveling worksurface cantilever can also include a height adjusting mechanism comprising a threaded rod that can adjust a height of the height adjusting and leveling worksurface cantilever, relative to a hanger bracket.

19 Claims, 15 Drawing Sheets

(58) Field of Classification Search
USPC ..... 108/42
See application file for complete search history.

(56) References Cited

U.S. PATENT DOCUMENTS

| | | | | |
|---|---|---|---|---|
| 2,668,317 | A | 2/1954 | Bon, III | |
| 3,207,099 | A * | 9/1965 | Black | A47B 23/046 108/147 |
| 3,820,478 | A | 6/1974 | Bergenthal | |
| 4,022,136 | A | 5/1977 | Schott | |
| 4,615,448 | A * | 10/1986 | Johnstonbaugh | A47F 5/0846 D25/123 |
| 4,804,066 | A | 2/1989 | Fusaro et al. | |
| 4,880,285 | A | 11/1989 | Brinkers | |
| 4,881,471 | A * | 11/1989 | Schwartz | A47B 9/06 108/147 |
| 4,969,403 | A | 11/1990 | Schwartz et al. | |
| 4,987,835 | A | 1/1991 | Schwartz et al. | |
| 5,033,014 | A | 7/1991 | Carver et al. | |
| 5,083,514 | A | 1/1992 | Schwartz et al. | |
| 5,177,917 | A | 1/1993 | Del Castillo Von Haucke | |
| 5,181,620 | A | 1/1993 | Watt | |
| 5,370,063 | A | 12/1994 | Childers | |
| 5,373,793 | A | 12/1994 | Crossman | |
| 5,535,972 | A * | 7/1996 | Fallago | A47B 96/061 248/245 |
| 5,549,053 | A * | 8/1996 | Grout | A47B 9/06 108/147 |
| 5,682,825 | A | 11/1997 | Manner | |
| 5,809,908 | A | 9/1998 | Catta et al. | |
| 6,024,025 | A * | 2/2000 | Koch | A47B 9/04 74/509 |
| 6,033,014 | A | 3/2000 | Nightengale | |
| 6,676,233 | B1 | 1/2004 | Evans et al. | |
| 7,412,931 | B2 | 8/2008 | Seidl et al. | |
| 7,461,484 | B2 | 12/2008 | Battey et al. | |
| 7,469,512 | B2 | 12/2008 | Faber et al. | |
| 7,676,992 | B2 | 3/2010 | Burns | |
| 7,703,242 | B2 | 4/2010 | Goebel et al. | |
| 8,186,281 | B2 | 5/2012 | Bastian et al. | |
| 8,256,358 | B2 | 9/2012 | Looser | |
| 8,424,983 | B1 | 4/2013 | Strauss et al. | |
| 9,593,481 | B2 | 3/2017 | Gosling et al. | |
| 9,693,624 | B2 | 7/2017 | Mitchell et al. | |
| 2001/0037751 | A1 | 11/2001 | Agee | |
| 2002/0059679 | A1 | 5/2002 | Weismiller et al. | |
| 2002/0171015 | A1 | 11/2002 | Gosling | |
| 2004/0022615 | A1 | 2/2004 | Land | |
| 2005/0172869 | A1 | 8/2005 | Schmidt | |
| 2006/0180057 | A1 | 8/2006 | Hallman | |
| 2008/0193062 | A1 | 8/2008 | Ropp | |
| 2012/0055293 | A1 | 3/2012 | Urick et al. | |
| 2012/0210949 | A1 | 8/2012 | Polacek | |
| 2012/0248046 | A1 | 10/2012 | Warner | |
| 2013/0241384 | A1 | 9/2013 | Strauss et al. | |
| 2015/0075086 | A1 | 3/2015 | Gosling et al. | |
| 2016/0066732 | A1 | 3/2016 | Sarvestani | |
| 2016/0213146 | A1 | 7/2016 | Gosling et al. | |
| 2016/0353876 | A1 | 12/2016 | Mitchell et al. | |
| 2018/0168334 | A1 | 6/2018 | Swartz et al. | |
| 2018/0344024 | A1 | 12/2018 | Kruger et al. | |
| 2020/0048899 | A1 | 2/2020 | Gosling et al. | |

FOREIGN PATENT DOCUMENTS

| | | | |
|---|---|---|---|
| CA | 2851489 | A1 | 11/2014 |
| CN | 204132702 | | 2/2015 |
| EP | 0083929 | | 7/1983 |
| EP | 0916284 | A2 | 5/1999 |
| GB | 2430869 | A | 4/2007 |
| JP | 06-020429 | Y2 | 6/1994 |
| JP | 07-000010 | | 1/1995 |
| JP | 07-000103 | | 1/1995 |
| JP | 07-150758 | A | 6/1995 |
| KR | 10-2011-0012547 | A | 2/2011 |
| KR | 10-2011-0125477 | A | 11/2011 |
| KR | 2011-0125477 | A | 11/2011 |
| NL | 8204262 | A | 6/1983 |
| WO | 00/24291 | A1 | 5/2000 |
| WO | 00/54628 | A1 | 9/2000 |
| WO | 2018213062 | | 11/2018 |

OTHER PUBLICATIONS

European Search Report for PCT/US2013/045024 dated Feb. 2, 2016.
International Preliminary Report on Patentability received for PCT Patent Application No. PCT/US20/023935, dated Sep. 30, 2021, 8 pages.
International Search Report and Written Opinion dated Sep. 13, 2018 from International Patent Application No. PCT/US2018/031574, filed May 8, 2018.
International Search Report and Written Opinion for application No. EP14836683 dated Sep. 29, 2016.
International Search Report and Written Opinion for PCT/US2013/045024 dated Jun. 10, 2013.
International Search Report and Written Opinion for PCT/US2014/050586 dated Dec. 3, 2014.
Office Action received for European Patent Application No. 13800179.7, dated Dec. 15, 2020, 12 pages.
Office Action received for European Patent Application No. 13800179.7, dated Feb. 8, 2019, 5 pages.
Translation of foreign document JP 06-020429 Y2 (Itoki Crebio Corp) Jun. 1, 1994.
Translation of foreign document JP 07-000103Y2 (Itoki Crebio Corp) Jan. 11, 1995.
Written Opinion for application No. 11201605987U dated Jun. 27, 2018.
International Search Report and Written Opinion for PCT/US2020/023935 dated May 25, 2020.
Singapore Written Opinion received for SG Application No. 11201906114Q, dated Jan. 12, 2021, 6 pages.
International Search Report and Written Opinion dated Sep. 13, 2018 from International Patent Application No. PCT/US2018/031574, dated Sep. 13, 2018.
European Search Report and Search Opinion Received for EP Application No. 18802712.2, dated Feb. 9, 2021, 9 pages.
European Invitation pursuant to Rule 62a(1) for EP Patent Application No. 18802712.2, dated Sep. 28, 2020, 4 pages.
Non-Final Office Action received for U.S. Appl. No. 16/339,925, dated Dec. 15, 2020, 10 pages.
Final Office Action received for U.S. Appl. No. 16/339,925, dated Jun. 28, 2021, 10 pages.
Final Office Action received for U.S. Appl. No. 16/339,925, dated Jun. 18, 2020, 12 pages.
Notice of Allowance received for U.S. Appl. No. 16/339,925, dated Nov. 8, 2021, 8 pages.
Office Action received for Singapore Patent Application No. 11201906114Q, dated Jan. 11, 2022, 8 pages.
Office Action received for European Patent Application No. 13800179.7, dated Apr. 13, 2022, 6 pages.
Intention to grant received for European Patent Application No. 13800179.7, dated Apr. 14, 2023, 9 pages.
Office Action received for Canada Patent Application No. 2887948, dated Jan. 18, 2022, 5 pages.

* cited by examiner

HEIGHT ADJUSTING AND LEVELING WORKSURFACE CANTILEVER

CROSS-REFERENCE TO RELATED APPLICATIONS

This application is a 371 US nationalization of PCT Patent Application No. PCT/US2020/023935, filed Mar. 20, 2020, which claims priority to U.S. provisional patent application No. 62/821,403, filed Mar. 20, 2019. The entire content of the aforementioned patent applications is incorporated herein by reference.

BACKGROUND

1. Technical Field

The present disclosure relates generally to worksurface cantilever systems and components for use with modular walls, conventional walls, and furniture systems.

2. Background and Relevant Art

Office space can be relatively expensive, not only due to the basic costs of the location and size of the office space. To combat these and other costs, organizations can partition space with modular assemblies. Modular assemblies can be relatively easy to assemble. Additionally, if the needs of the organization change, the modular assemblies can be disassembled and reassembled in a different configuration without the attendant costs of destroying and rebuilding permanent walls.

Modular assemblies can also serve as adaptable backbones for various types of modular furniture. For example, organizations can use modular wall systems as supports for cantilevered items, such as work surface, or other sorts of furniture. Cantilevered items may contain a hooking feature that can be angled into a recess in a modular wall, so that when the assembler drops the feature back into a standard position, the combination of the cantilever cavity, hooking feature, and weight of the furniture item against the modular wall stably hold the furniture item in position.

One will appreciate, however, that despite such items being relatively easy to assemble and remove, given construction tolerances and material flexibility, cantilevered worksurfaces may sag or rise rather than being completely level as intended. Also, over time cantilevered worksurfaces can have the tendency to angle downward with weight. Any significant weight added to or removed from cantilevered worksurfaces during may result in non-level worksurfaces.

Further, many height-adjustable cantilevered worksurfaces are bulky, cumbersome, and unattractive. Adjusting the height of cantilevered worksurfaces can take time, may accommodate only discrete height adjustments, and may require disassembly if adjusted after worksurface installation. It may also be necessary to support the full weight borne by the worksurface cantilever during the height adjustment process.

Accordingly, there are a number of disadvantages in the art that can be addressed.

BRIEF SUMMARY

Implementations of the present disclosure comprise systems, methods, and apparatus for height adjusting and leveling a cantilevered worksurface. More specifically, implementations of the present disclosure allow a manufacturer, an installer, or a user to adjust the height and angle of a height adjusting and leveling worksurface cantilever or a height adjusting and leveling worksurface cantilever system.

For example, in at least one implementation, a height adjusting and leveling worksurface cantilever can comprise a leveling mechanism comprising a turnbuckle rod that can adjust an angle of a horizontal frame member relative to a vertical frame member. An assembler can adjust the angle of the horizontal frame member from a pivot point located on a proximal corner of the height adjusting and leveling worksurface cantilever. The height adjusting and leveling worksurface cantilever can also include a height adjusting mechanism comprising a threaded rod that can adjust a height of the height adjusting and leveling worksurface cantilever, relative to a hanger bracket.

In at least one additional or alternative implementation of the present invention, the height adjusting and leveling worksurface cantilever can comprise a leveling mechanism comprising a turnbuckle rod that can adjust an angle of a horizontal frame member relative to a vertical frame member. The assembler can adjust the angle of the horizontal frame member from a pivot point located on a proximal corner of the height adjusting and leveling worksurface cantilever. The horizontal frame member can comprise a distal end and a proximal end and the vertical frame member can comprise a distal end and a proximal end.

The turnbuckle rod can extend from a point between the distal end and the proximal end of the horizontal frame member to a point between the proximal end and the distal end of the vertical frame member. The height adjusting and leveling worksurface cantilever can also include a height adjusting mechanism comprising a threaded rod that can adjust a height of the height adjusting and leveling worksurface cantilever, relative to a hanger bracket. The threaded rod can extend from the distal end of the vertical frame member to the proximal end of the vertical frame member.

Further, a height adjusting and leveling worksurface cantilever system can comprise at least one worksurface and at least two height adjusting and leveling worksurface cantilevers. Each of the at least two height adjusting and leveling worksurface cantilevers can comprise a turnbuckle rod that is configured to adjust the angle of the at least one worksurface relative to a vertical frame member via a horizontal frame member. The assembler can adjust the angle of the at least one worksurface from a pivot point located on a proximal corner of each of the at least two horizontal frame members. Each of the at least two height adjusting and leveling worksurface cantilevers can also include a threaded rod configured to adjust the height of the at least one worksurface and the at least two height adjusting and leveling worksurface cantilevers relative to at least two hanger brackets.

Additional features and advantages will be set forth in the description which follows, and in part will be obvious from the description, or may be learned by practice. The features and advantages may be realized and obtained by means of the instruments and combinations particularly pointed out in the appended claims. These and other features will become more fully apparent from the following description and appended claims, or may be learned by the practice of the examples as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments and/or implementations thereof which are illustrated in the appended drawings. Understanding that these drawings depict only typical embodiments and/or implementations of the invention and are not therefore to be considered to be limiting of its scope, the invention will be described and explained with additional specificity and detail through the use of the accompanying drawings in which.

DETAILED DESCRIPTION

Figure 1:
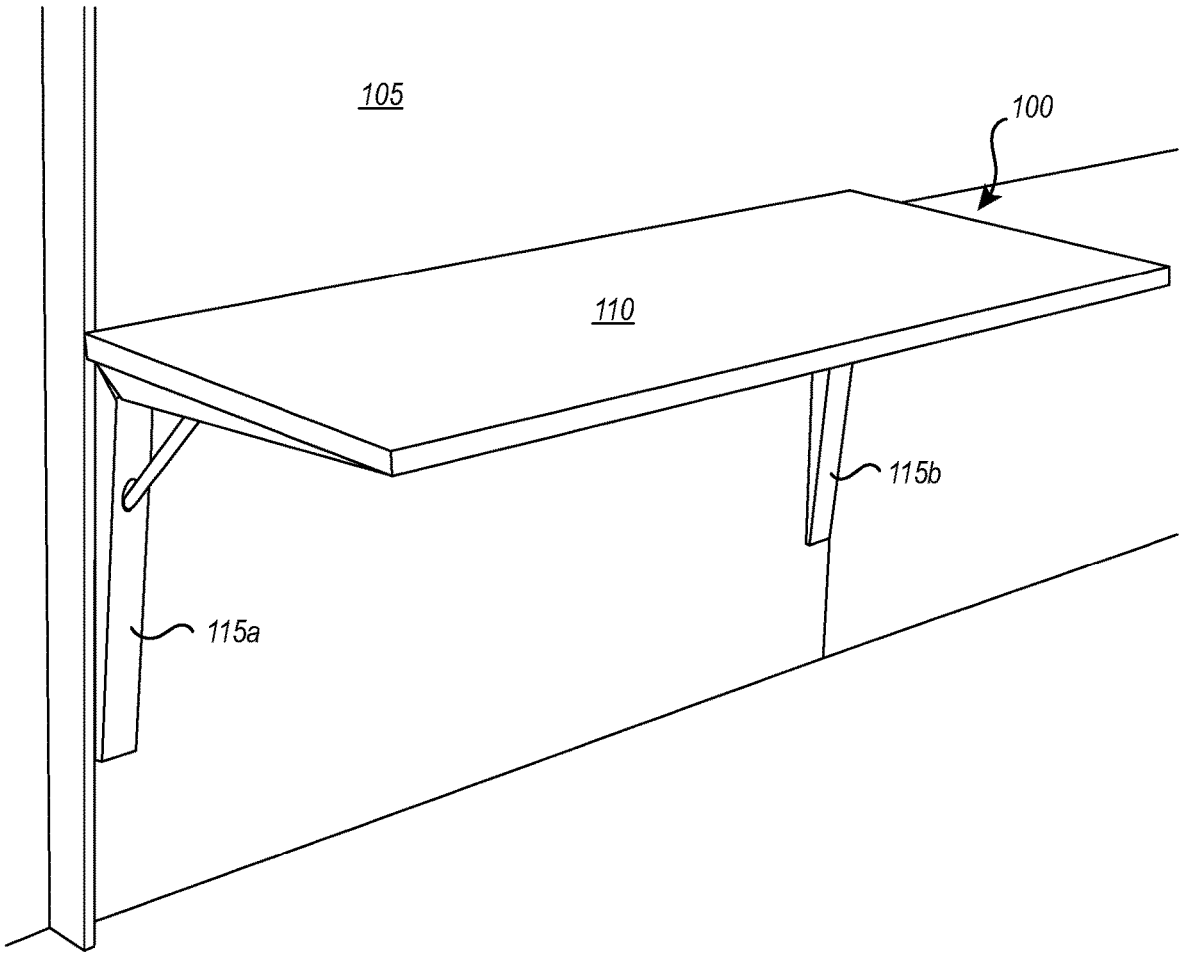
FIG. 1 illustrates of an exemplary height adjusting and leveling worksurface cantilever system in accordance with the present disclosure.

Implementations of the present disclosure comprise systems, methods, and apparatus for height adjusting and leveling a cantilevered worksurface. More specifically, implementations of the present disclosure allow a manufacturer, an installer, or a user to adjust the height and angle of a height adjusting and leveling worksurface cantilever or a height adjusting and leveling worksurface cantilever system.

For example, in at least one implementation, a height adjusting and leveling worksurface cantilever can comprise a leveling mechanism comprising a turnbuckle rod that can adjust an angle of a horizontal frame member relative to a vertical frame member. An assembler can adjust the angle of the horizontal frame member from a pivot point located on a proximal corner of the height adjusting and leveling worksurface cantilever. The height adjusting and leveling worksurface cantilever can also include a height adjusting mechanism comprising a threaded rod that can adjust a height of the height adjusting and leveling worksurface cantilever, relative to a hanger bracket.

Because cantilevered worksurfaces have the tendency to angle downward with weight, other cantilevered worksurfaces may provide for worksurface angling. However, the pivot point of these leveling mechanisms is often distant from the rear end of the horizontal frame member, and the leveling mechanisms raise and lower the worksurface relative to the horizontal frame member. Such a leveling mechanism can create a gap between the horizontal frame member and the worksurface when the worksurface is angled upward. Fastening components (e.g. screws or bolts) that attach the worksurface to the horizontal frame member may also become visible when the worksurface is angled upward. Furthermore, the rear edge of a worksurface may rise and fall and may move forward and backward when angle is adjusted, thus creating gaps and misalignments.

Alternatively, in at least one implementation of the present invention, the pivot point of the leveling mechanism is at the upper rear end of the horizontal frame member, and the leveling mechanism raises and lowers the horizontal frame member and the worksurface. Therefore, in at least one implementation, no gaps or fastening components are visible when the horizontal frame member and worksurface are angled upward to account for weight on the worksurface. Additionally or alternatively, the leveling to mechanism can angle the horizontal frame member and worksurface downward. Also, because in at least one implementation the pivot point of the leveling mechanism is at the rear end of the horizontal frame member, the rear surface of the worksurface does not significantly rise and fall when the installer or user employs the leveling mechanism.

Additionally, because in at least one implementation of the present invention the height adjusting mechanism adjusts the height of the worksurface relative to the at least two hanger brackets, the height adjusting and leveling worksurface cantilever system does not require an installer or user to change the size of the hanger brackets depending on the thickness of the worksurface the installer or user installs. Other cantilevered worksurfaces may be height adjustable relative to a vertical frame member, and therefore can require longer hanger brackets when a user chooses a thicker worksurface. In at least one implementation of the present invention, an installer or user can use the same sized hanger brackets with any thickness of worksurface. The use of universally compatible hanger brackets is also a benefit to the manufacturer, who would no longer have to produce and stock various sized hanger brackets.

Further, in at least one implementation of the present invention, the height adjusting mechanism allows for continuous worksurface height adjustment. The height adjusting mechanisms of other cantilevered worksurfaces often adjust the height of the worksurface in discrete, incremental units. At least one implementation of the height adjusting mechanism in the present invention employs a threaded rod, which allows the worksurface to be continuously adjustable. Also, in at least one implementation, the installer or user can adjust the height of the worksurface while the worksurface is supporting weight.

Moving now to the Figures, FIG. 1 illustrates of an exemplary height adjusting and leveling worksurface cantilever system 100 that is installed into a modular wall system 105. As shown, the height adjusting and leveling worksurface cantilever system 100 can include a worksurface 110 and a first and second height adjusting and leveling worksurface cantilever 115*a* and 115*b*.

One skilled in the art will appreciate that the height adjusting and leveling worksurface cantilever system 100 is not limited to that shown in FIG. 1. For example, the height adjusting and leveling worksurface cantilever system 100 may comprise an additional worksurface. Rather than securing the additional worksurface with two additional height adjusting and leveling worksurface cantilevers, a centrally positioned second height adjusting and leveling worksurface cantilever 115*b* can be configured to secure the additional worksurface at a first end (along with the worksurface 110), and a third height adjusting and leveling worksurface cantilever can secure the additional worksurface at a second end.

Figure 2A:
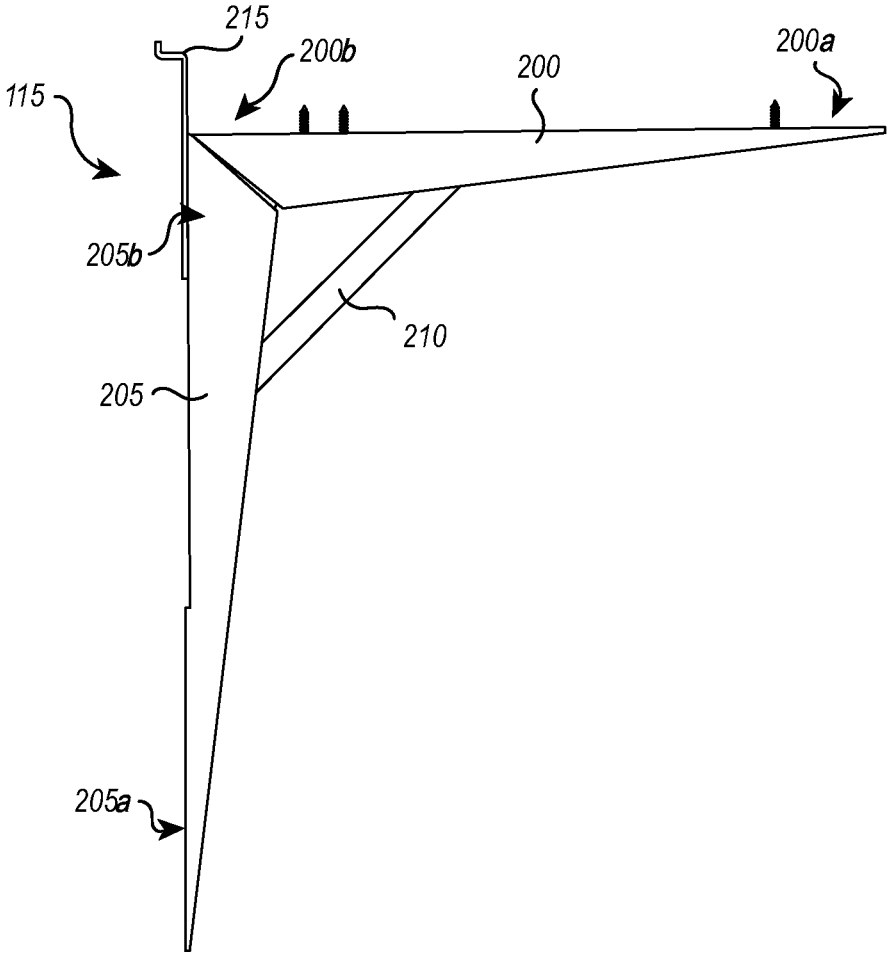
FIG. 2A illustrates a left, side view of an exemplary height adjusting and leveling worksurface cantilever in accordance with the present disclosure.
Figure 2B:
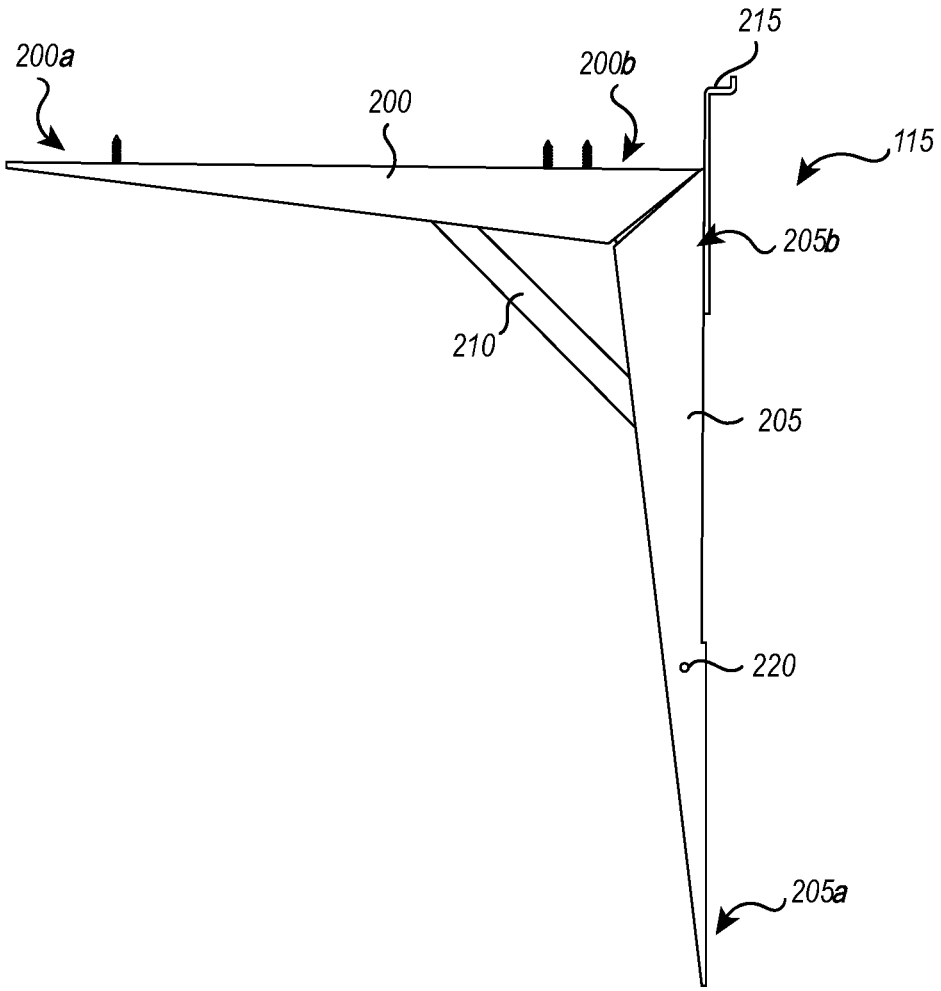
FIG. 2B illustrates a right, side view of the exemplary height adjusting and leveling worksurface cantilever illustrated in FIG. 2A.

FIG. 2A shows a left, side view of an exemplary height adjusting and leveling worksurface cantilever 115, and FIG. 2B shows a right, side view of the exemplary height adjusting and leveling worksurface cantilever 115. As shown in FIGS. 2A and 2B, the height adjusting and leveling worksurface cantilever 115 can include a horizontal frame member 200 (comprising a distal end 200*a* and a proximal end 200*b*), a vertical frame member 205 (comprising a distal end 205*a* and a proximal end 205*b*), a turnbuckle rod 210, and a hanger bracket 215.

FIG. 2B shows a side socket head cap screw 220 that is coupled to a height adjusting mechanism within the height adjusting and leveling worksurface cantilever 115 and can be used to adjust the height of the height adjusting and leveling worksurface cantilever 115. One skilled in the art will appreciate that the side socket head cap screw 220 is not limited to placement on the right side of the height adjusting and leveling worksurface cantilever 115. In at least one implementation, the side socket head cap screws 220 of the first and second height adjusting and leveling worksurface cantilever 115*a* and 115*b* both face inward, thereby limiting the visible fastening components. Alternatively, the side socket head cap screw 220 can be front facing.

Figure 2C:
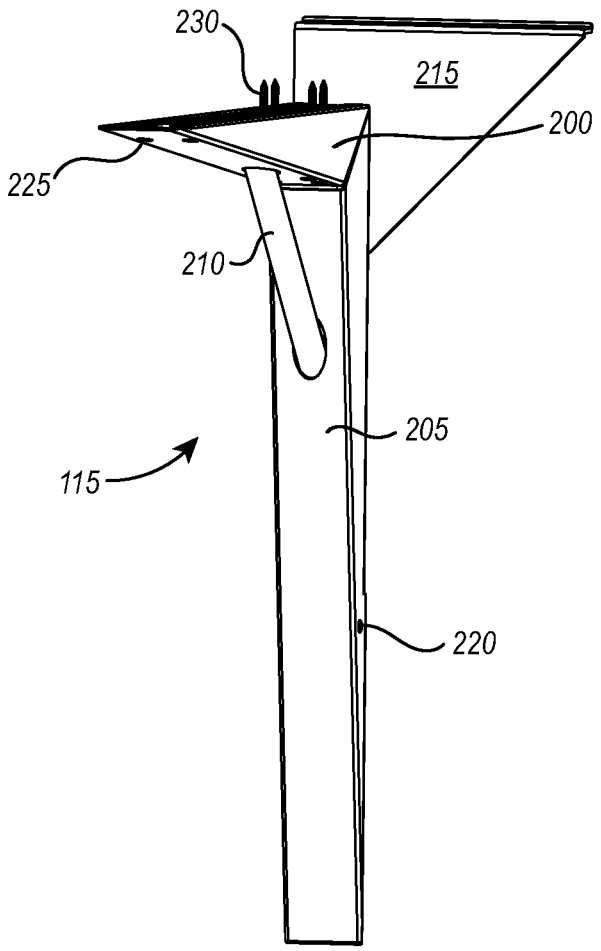
FIG. 2C illustrates a front, right view of the exemplary height adjusting and leveling worksurface cantilever illustrated in FIGS. 2A and 2B.

Similarly, FIG. 2C shows a front, right view of the exemplary height adjusting and leveling worksurface cantilever 115 shown in FIGS. 2A and 2B, which comprises the horizontal frame member 200, the vertical frame member 205, the turnbuckle rod 210, the hanger bracket 215, and the side socket head cap screw 220. FIG. 2C also shows multiple openings 225 in the horizontal frame member 200 from some of which fastening components 230 are protruding. The openings 225 and fastening components 230 can be used to secure a worksurface to the horizontal frame member 200. Although FIG. 2C shows the fastening components 230 as screws, one skilled in the art will appreciate that any type of fastening component can be used (e.g., bolts).

The triangular shape of the hanger bracket 215 shown in FIG. 2C can provide necessary structure to prevent the bracket from bending. However, one skilled in the art will also appreciate that the hanger bracket 215 is not limited to the size and shape shown in FIG. 2C (see FIG. 7). The size and shape of the hanger bracket 215 can depend on the size and weight of the worksurface 110. In at least one implementation the hanger bracket 215 is sized and shaped so no portion of the hanger bracket 215 extends beyond the perimeter of vertical frame member 205.

Figure 2D:
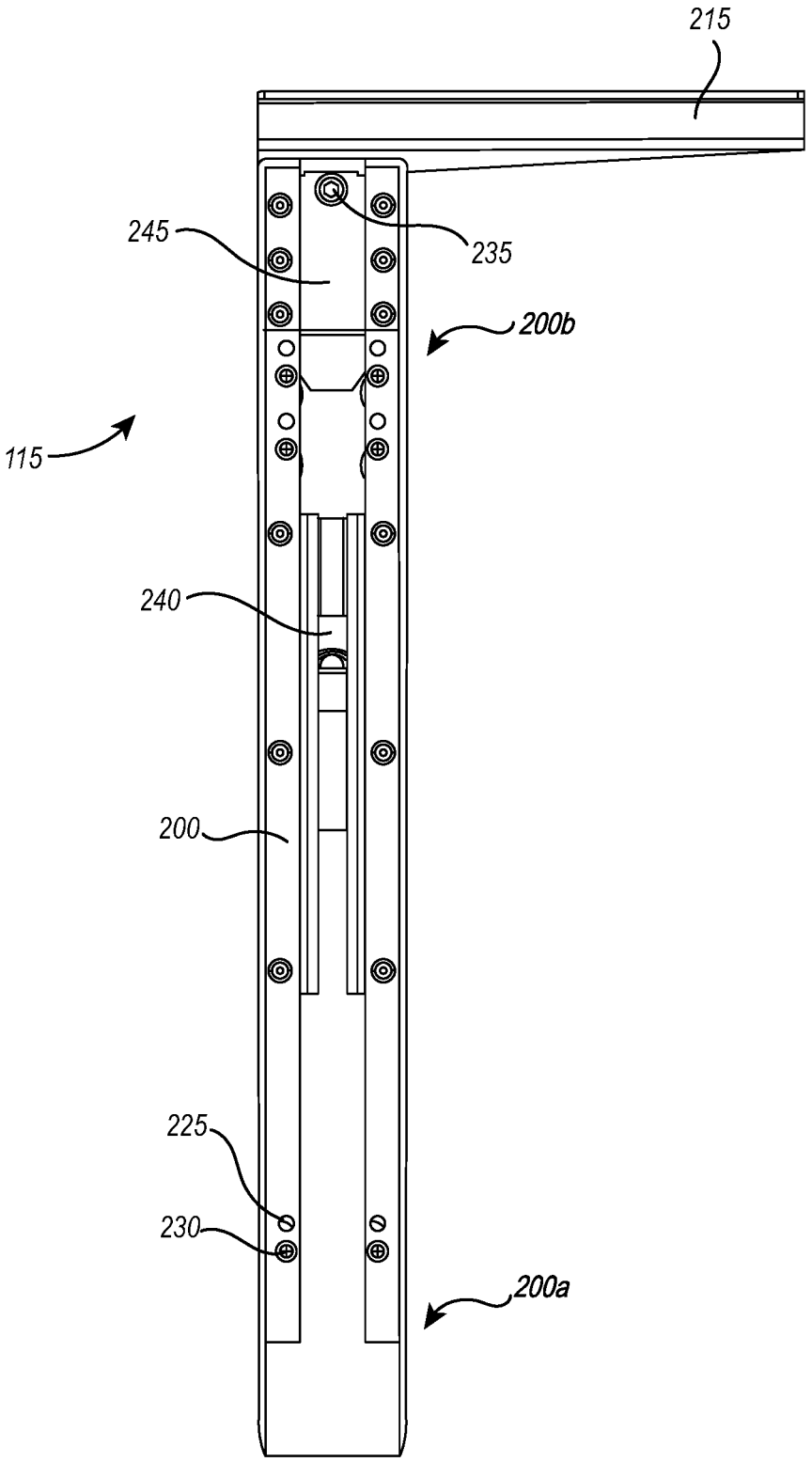
FIG. 2D illustrates a top view of the exemplary height adjusting and leveling worksurface cantilever illustrated in FIGS. 2A-2C.

FIG. 2D shows a top view of the exemplary height adjusting and leveling worksurface cantilever 115 shown in FIGS. 2A-2C. Again, the height adjusting and leveling worksurface cantilever 115 includes the horizontal frame member 200 (that includes the distal end 200*a* and the proximal end 200*b*) and the hanger bracket 215. FIG. 2D also shows a top socket head cap screw 235 at the proximal end 200*b* of the horizontal frame member 200, which, similar to the side socket head cap screw 220 shown in FIGS. 2B and 2C, is coupled to the height adjusting mechanism within the height adjusting and leveling worksurface cantilever 115. The top socket head cap screw can be used to adjust the height of the height adjusting and leveling worksurface cantilever 115.

Further, like FIG. 2C, FIG. 2D shows the openings 225 and the fastening components 230 that can be used to secure a worksurface to the horizontal frame member 200. In at least one implementation, the horizontal frame member 200 is sized so the fastening components 230 fit completely within the openings 225, which can prevent the user's skin and/or clothes from catching on the fastening components 230.

One skilled in the art will appreciate that the present invention is not limited to the number of openings 225 or the number of fastening components 230 in the horizontal frame member 200 shown in either FIG. 2C or 2D. In at least one implementation, the horizontal frame member 200 has two rows of three openings 225 for fastening components 230 to attach the worksurface to the horizontal frame member 200. Four openings (two rows of two openings) 225 may be located near the rear end of the horizontal frame member 200, and two openings (two rows of one opening) 225 may be located near the front end of the horizontal frame member 200. FIG. 2D shows the horizontal frame member 200 may have additional openings 225 besides these six openings 225 to provide for additional weight or installer/user error. In at least one embodiment where two worksurfaces are joined to form a single worksurface, each of the rows of openings 225 in the horizontal frame member 200 is used to attach a separate worksurface to a centrally positioned height adjusting and leveling worksurface cantilever 115.

FIG. 2D also shows a top view of a turnbuckle mount 240 secured within the horizontal frame member 200. As will be explained in more detail later, the turnbuckle mount 240 connects the horizontal frame member 200 to the turnbuckle rod 210 (not shown). A pivot spring bracket 245 is also shown in FIG. 2D. The pivot spring bracket 245 is secured to both the proximal end 200*b* of the horizontal frame member 200 and the proximal end 205*b* of the vertical frame member 205 and is the pivot point when the leveling mechanism is engaged and the angle of the horizontal frame member 200 relative to the vertical frame member 205 increases or decreases.

Figure 2E:
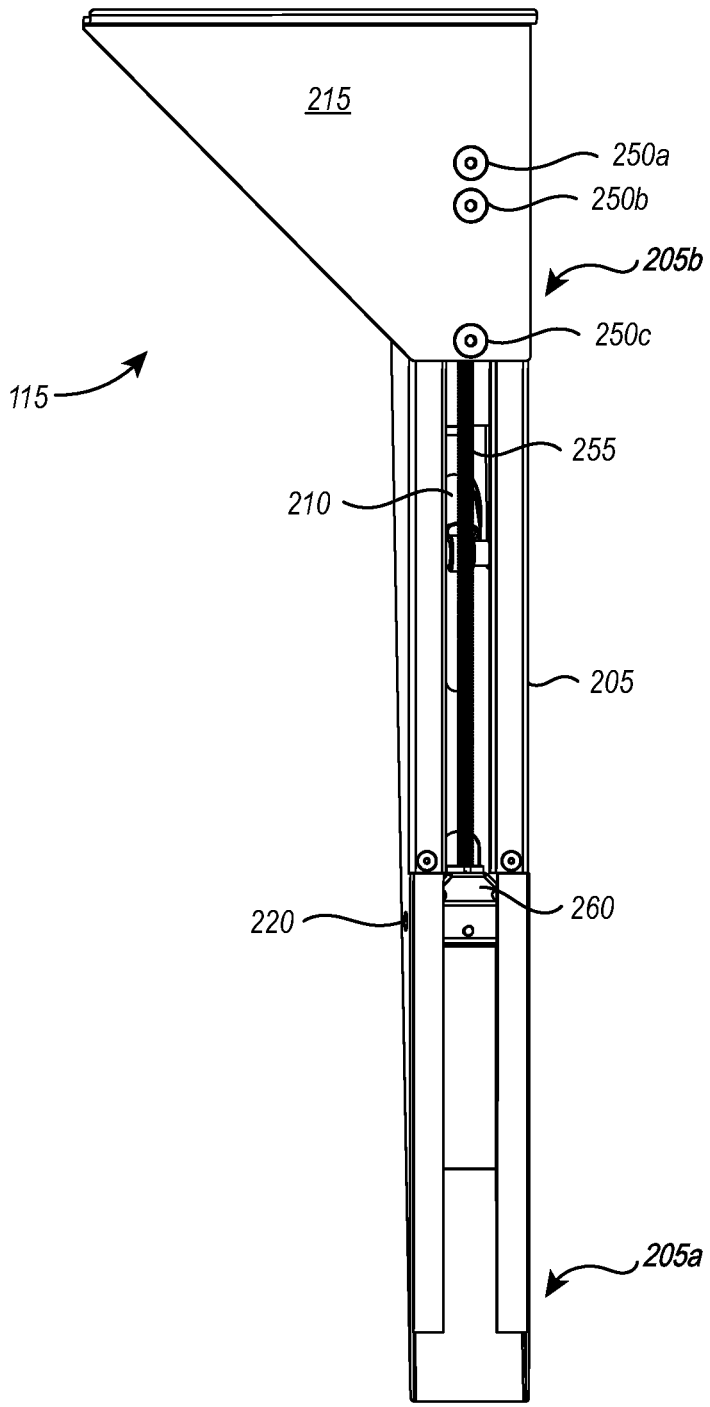
FIG. 2E illustrates a rear view of the exemplary height adjusting and leveling worksurface cantilever illustrated in FIGS. 2A-2D.

FIG. 2E is a rear view of the exemplary height adjusting and leveling worksurface cantilever 115. As shown, the height adjusting and leveling worksurface cantilever 115 includes the vertical frame member 205 (that includes the distal end 205*a* and the proximal end 205*b*) and the hanger bracket 215. FIG. 2E shows that three flat head socket screws 250*a*-250*c* connect the hanger bracket 215 to a portion of the height adjusting and leveling worksurface cantilever 115. Within the vertical frame member 205, a portion of the turnbuckle rod 210 is shown where the turnbuckle rod 210 attaches to the vertical frame member 205. Portions of a height adjusting mechanism can also be seen in FIG. 2E, including a threaded rod 255 and a gearbox 260. The side socket head cap screw 220 is also shown in FIG. 2E.

Figure 3A:
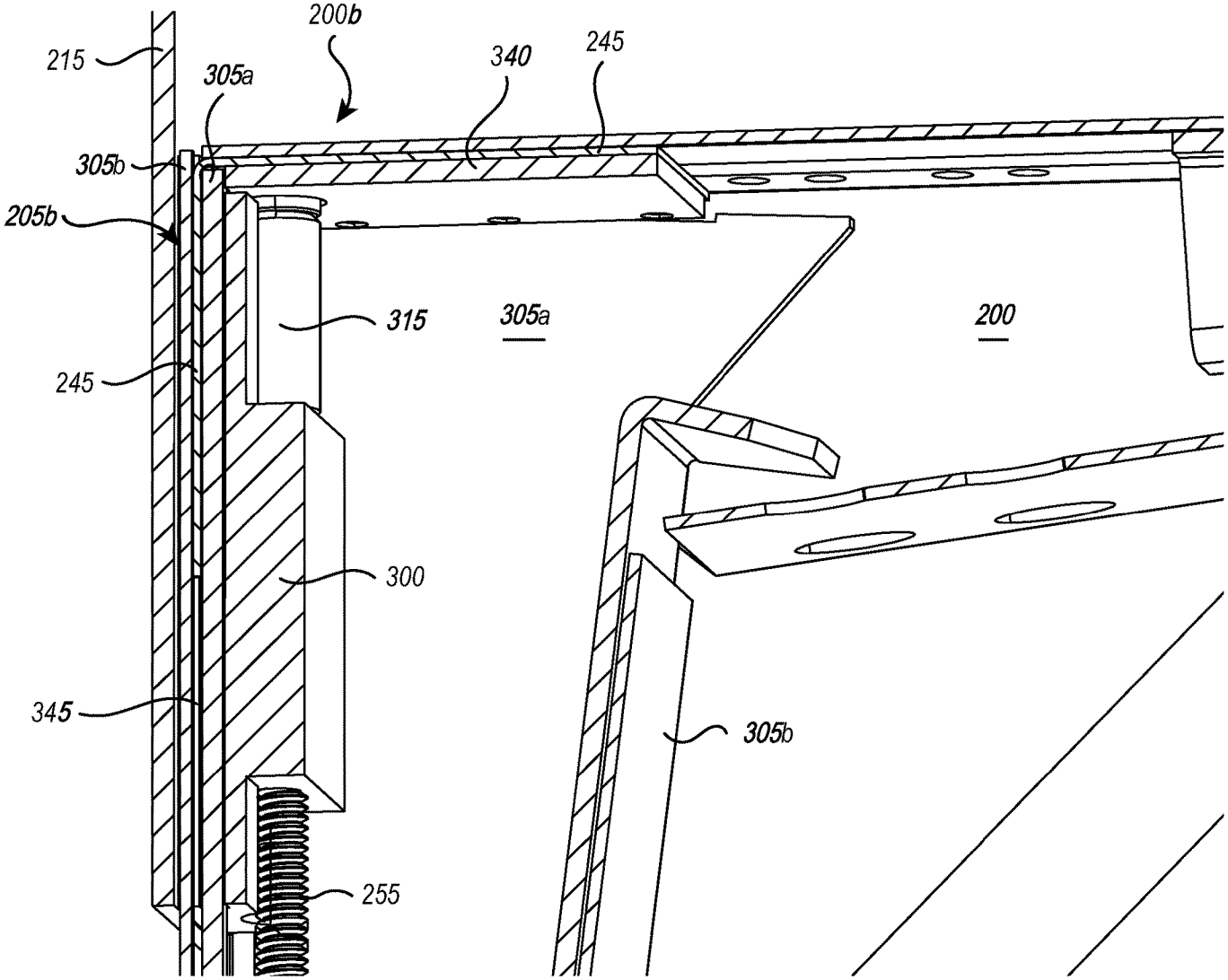
FIG. 3A illustrates a left side, sectional view of an exemplary height adjusting and leveling worksurface cantilever in accordance with the present disclosure.

FIG. 3A is a left side, sectional view of an upper portion of the height adjusting mechanism of the height adjusting and leveling worksurface cantilever 115. FIG. 3A shows how the various components of the height adjusting and leveling worksurface cantilever 115 fit together. For example, FIG. 3A shows the vertical frame member 205 can comprise an inner vertical frame member 305*a* and an outer vertical frame member 305*b* that fit together to create the vertical frame member 205. As shown, the pivot spring bracket 245 can extend from the proximal end 200*b* of the horizontal frame member 200 to the proximal end 205*b* of the vertical frame member 205. In at least one implementation, the pivot spring bracket 245 fits in a vertical space between the inner vertical frame member 305*a* and the outer vertical frame member 305*b*.

Further, FIG. 3A shows a tapped load plate 300, a coupling nut 315, and the threaded rod 255. The tapped load plate 300 can be secured to the hanger bracket 215 via the three flat head socket screws 250*a*-250*c* shown in FIG. 2E. One skilled in the art will appreciate that the means and/or number of fastening components shown in the Figures does not limit the present invention. The tapped load plate 300 may be secured to the hanger bracket 215 by any suitable means.

In at least one implementation, the threaded rod 255 is coupled to the top socket head cap screw 235 shown in FIG. 2D. When the installer or user turns the top socket head cap screw 235, the top socket head cap screw 235 causes the threaded rod 255 to rotate axially. The movement of the threaded rod 255 axially causes the height adjusting and leveling worksurface cantilever 115 to move up or down relative to the hanger bracket 215 and the attached tapped load plate 300.

FIG. 3A further shows that the upper portion of the height adjusting mechanism of the height adjusting and leveling worksurface cantilever 115*a* can include a horizontal load plate 340 to help bear weight of the worksurface 110. Also, FIG. 3A shows a top portion of a length of VHB tape 345. Two such lengths of VHB tape 345 can be used to fill gaps left in the height adjusting and leveling worksurface cantilever 115 assembly between the inner vertical frame member 305*a* and the outer vertical frame member 305*b* below the pivot spring bracket 245. One skilled in the art will appreciate that any means of filling the gaps may be used in accordance with the present invention. In at least one implementation the gaps are not filled with any material.

Figure 3B:
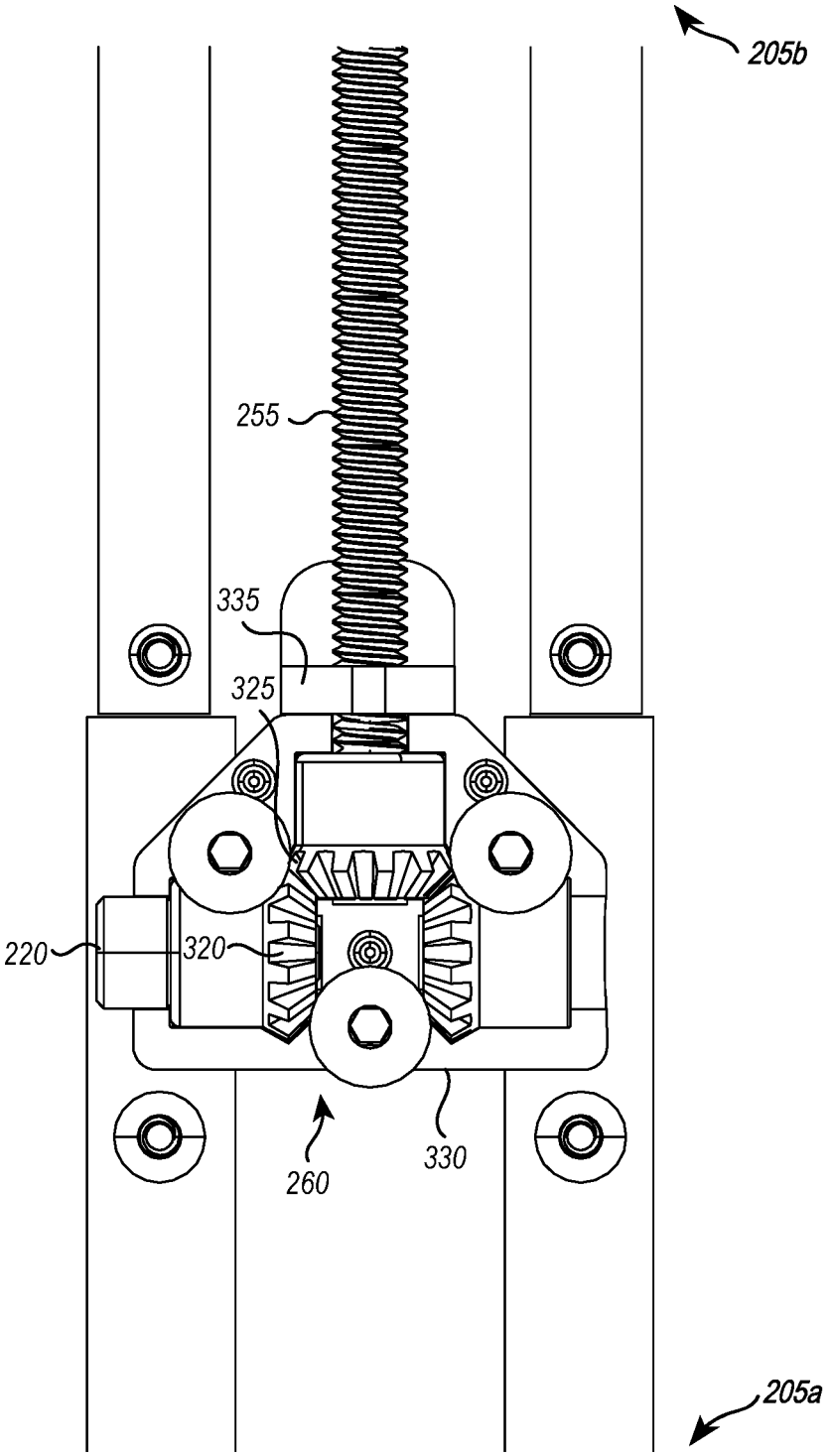
FIG. 3B illustrates a rear, sectional view of the exemplary height adjusting and leveling worksurface cantilever shown in FIG. 3A.

FIG. 3B shows an alternative mechanism by which the installer or user can adjust the height of the height adjusting and leveling worksurface cantilever 115. FIG. 3B is a rear, sectional view of a lower portion of the height adjusting mechanism, which includes the gearbox 260. At least two gears, a primary gear 320 and a secondary gear 325 are located within a gearbox casting 330. As shown in FIG. 3B, the primary gear 320 is coupled to the side socket head cap screw 220 shown in FIGS. 2B, 2C, and 2E. When the installer or user turns the side socket head cap screw 220, the side socket head cap screw 220 can cause the primary gear 320 to rotate, which in turn engages with the secondary gear 325 and causes the secondary gear 325 to turn. The secondary gear 325 can be coupled to the threaded rod 255, so rotation of the secondary gear 325 causes the threaded rod 255 to rotate axially, thereby raising or lowering the height adjusting and leveling worksurface cantilever 115. In at least one implementation, a steel tab 335 is included on the inner vertical frame member 305*a* next to the gearbox casting 330 and prevents the gearbox casting 330 from breaking as a result of weight of the worksurface.

Figure 4A:
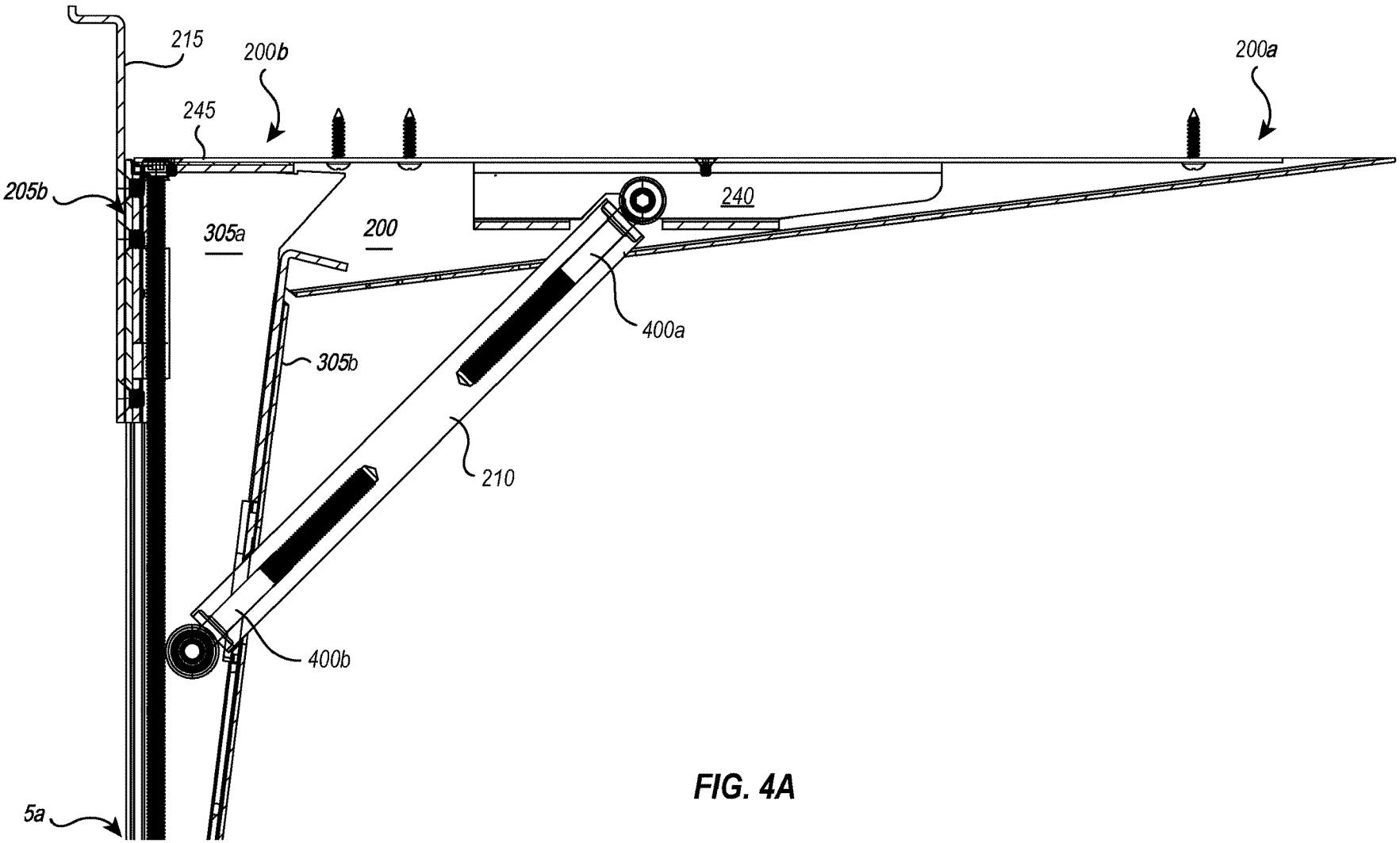
FIG. 4A illustrates a left, side, sectional view of an exemplary height adjusting and leveling worksurface cantilever in accordance with the present disclosure.

FIG. 4A is a left, side, sectional view of an exemplary height adjusting and leveling worksurface cantilever 115 that shows the leveling mechanism in detail. As shown in FIG. 4A, the turnbuckle rod 210 extends from the turnbuckle mount 240 within the horizontal frame member 200 to the space within the inner vertical frame member 305*a*. The turnbuckle rod 210 can attach to the turnbuckle mount 240 via a first turnbuckle threaded rod 400*a*. In at least one implementation, the first turnbuckle threaded rod 400*a* has left-handed threads. The turnbuckle can attach to the inner vertical frame member 305*a* via a second turnbuckle threaded rod 400*b*. In at least one implementation, the second turnbuckle threaded rod 400*b* has right-handed threads.

An installer or user can angle the height adjusting and leveling worksurface cantilever 115 upward or downward by rotating the turnbuckle rod 210 either left or right. The axial rotation of the turnbuckle rod 210 can cause either the extension or retraction of the first and second turnbuckle threaded rods 400*a* and 400*b*, which will cause the horizontal frame member 200 (and the worksurface if attached) to angle upward or downward at the pivot spring bracket 245.

Figure 4B:
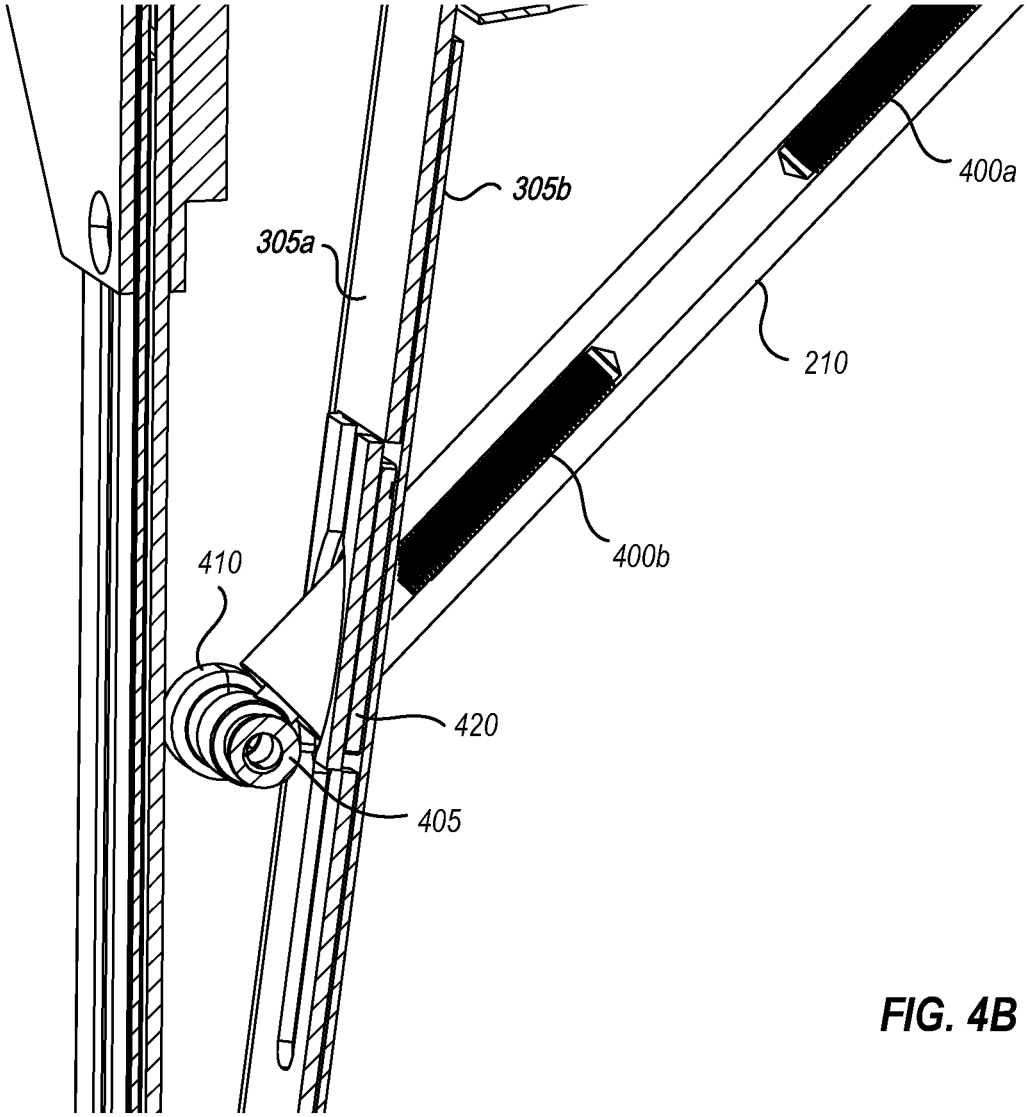
FIG. 4B is illustrates a left, side, sectional view of an exemplary height adjusting and leveling worksurface cantilever in accordance with the present disclosure from a viewpoint closer than that shown in FIG. 4A.

Likewise, FIG. 4B is a closeup, left, side, sectional view of the exemplary height adjusting and leveling worksurface cantilever 115 shown in FIG. 4A and shows how the turnbuckle rod 210 attaches to the inner vertical frame member 305*a*. As shown, a looped, proximal end of the second turnbuckle threaded rod 400*b* fits between a threaded spacer 405 and a counterbore spacer 410, which can both be welded to the inner vertical frame member 305*a*. A cap head socket screw (not shown) can run through the counterbore spacer 410 and the looped and distal end of the second turnbuckle threaded rod 400*b*, thereby securing to the threaded spacer 405.

FIG. 4B also shows a gasket plate 420 fitted between the inner vertical frame member 305*a* and the outer vertical frame member 305*b*. In at least one implementation, the gasket plate 420 moves upward and downward depending on the angling of the horizontal frame member 200. The gasket plate 420 can cover a portion of the hole required to account for the movement of the turnbuckle rod 210 and thereby aid in the appearance of the height adjusting and leveling worksurface cantilever 115.

Figure 5:
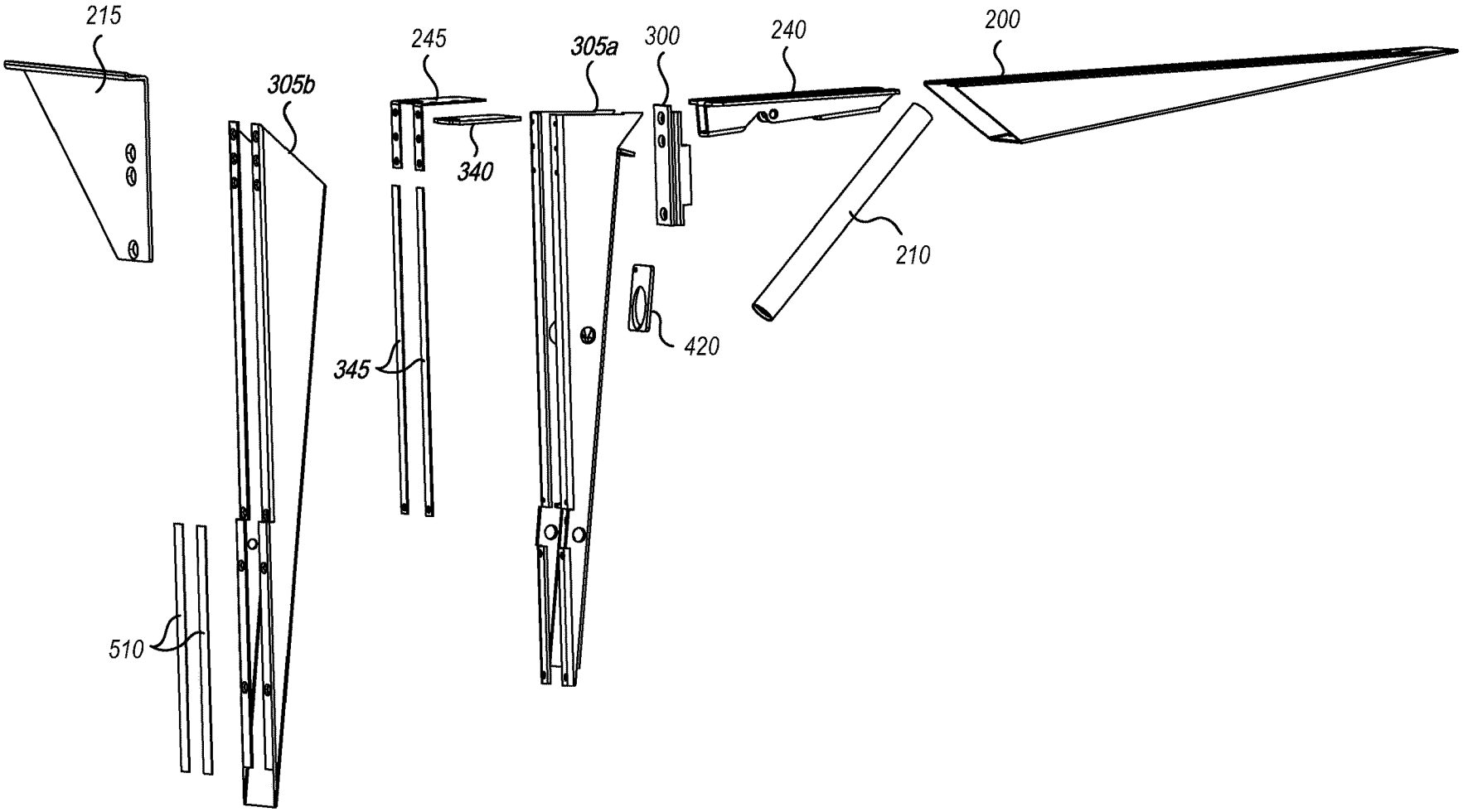
FIG. 5 illustrates an exploded view of some of the components of an exemplary height adjusting and leveling worksurface cantilever in accordance with the present disclosure.

FIG. 5 is an exploded view of some of the components of an exemplary height adjusting and leveling worksurface cantilever 115. FIG. 5 shows the horizontal frame member 200, the turnbuckle mount 240, the turnbuckle rod 210, the tapped load plate 300, the inner vertical frame member 305*a*, the gasket plate 420, the horizontal load plate 340, the pivot spring bracket 245, the outer vertical frame member 305*b*, and the hanger bracket 215. FIG. 5 also shows the two lengths of VHB tape 345, which as described above are used to fill gaps left in the height adjusting and leveling worksurface cantilever 115 assembly between the inner vertical frame member 305*a* and the outer vertical frame member 305*b* below the pivot spring bracket 245.

Further, FIG. 5 shows two Velcro loop lengths 510 on the lower surface of the outer vertical frame member 305*b*. The two Velcro loop lengths 510 can protect the attached modular wall system 105 from any damage caused by height adjusting and leveling worksurface cantilever system 100. One skilled in the art will appreciate that the present invention is not limited to the use of the two Velcro loop lengths 510. Any material that may protect the attached modular wall system 105 from damage can be used in accordance with the present invention. In at least one implementation, no Velcro loop lengths 510 or material is used to prevent damage to the attached modular wall system 105.

Figure 6A:
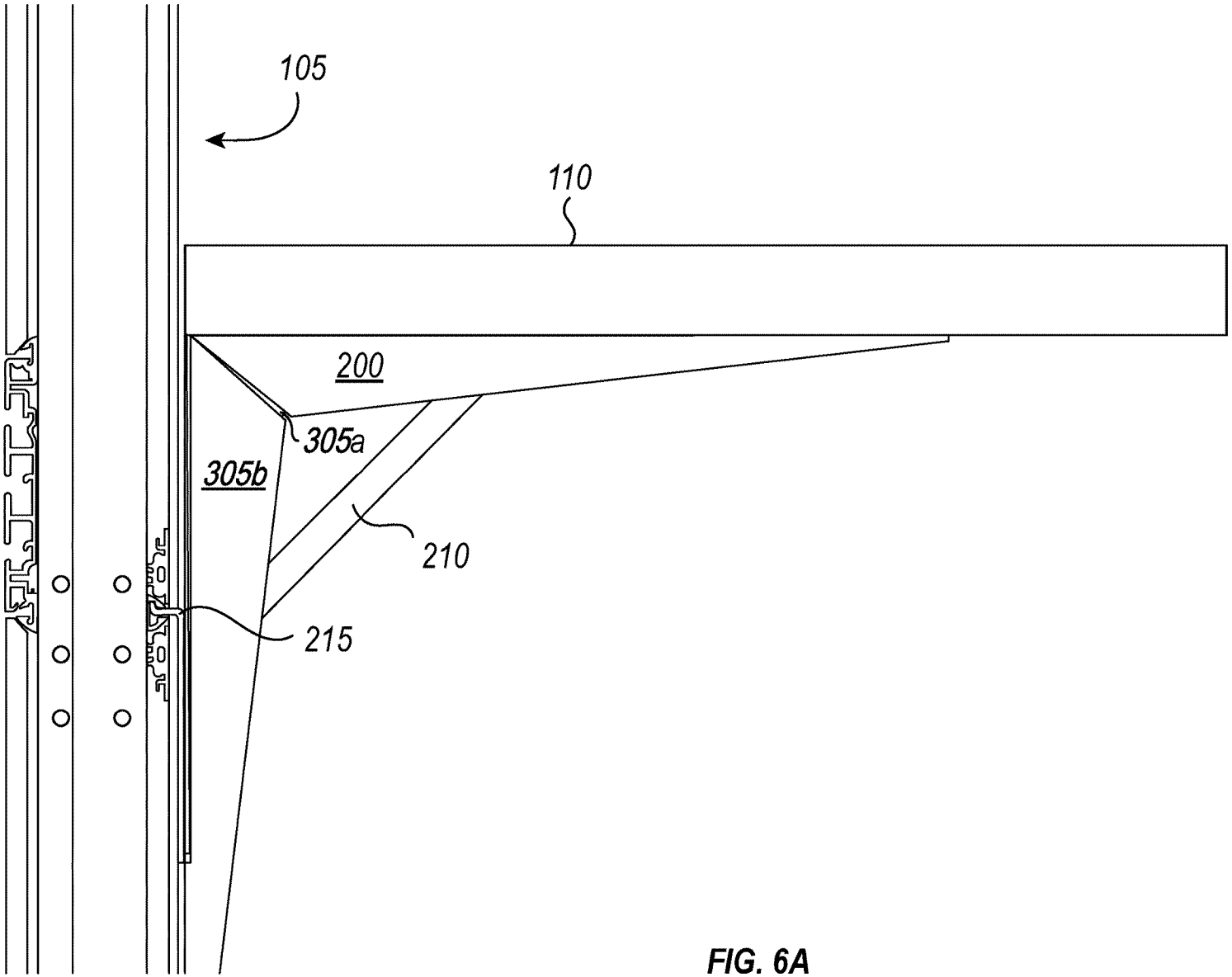
FIG. 6A illustrates an exemplary height adjusting and leveling worksurface cantilever angled at 90 degrees and in a raised height position.
Figure 6B:
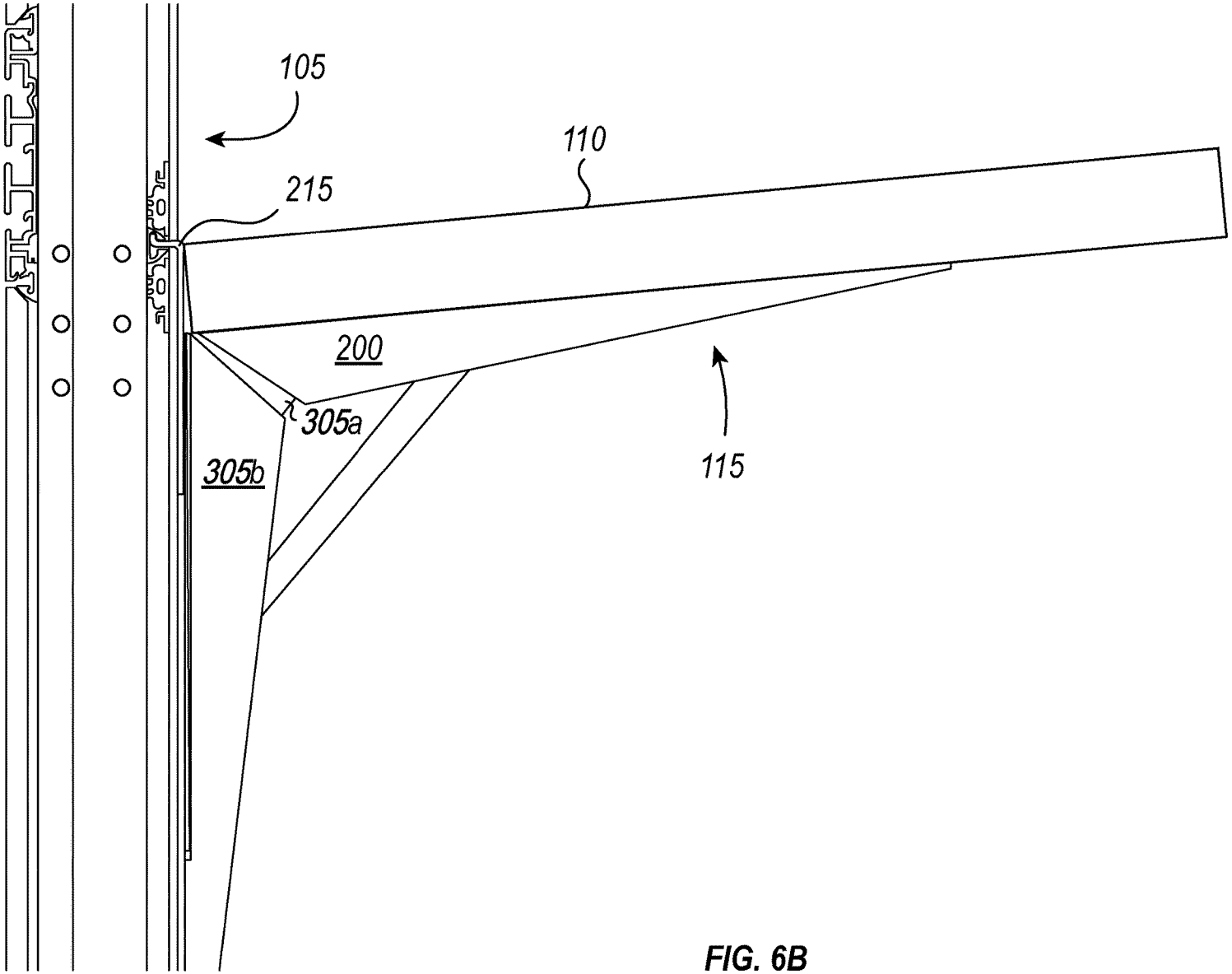
FIG. 6B illustrates an exemplary height adjusting and leveling worksurface cantilever angled upward and in a lowered height position.
Figure 6C:
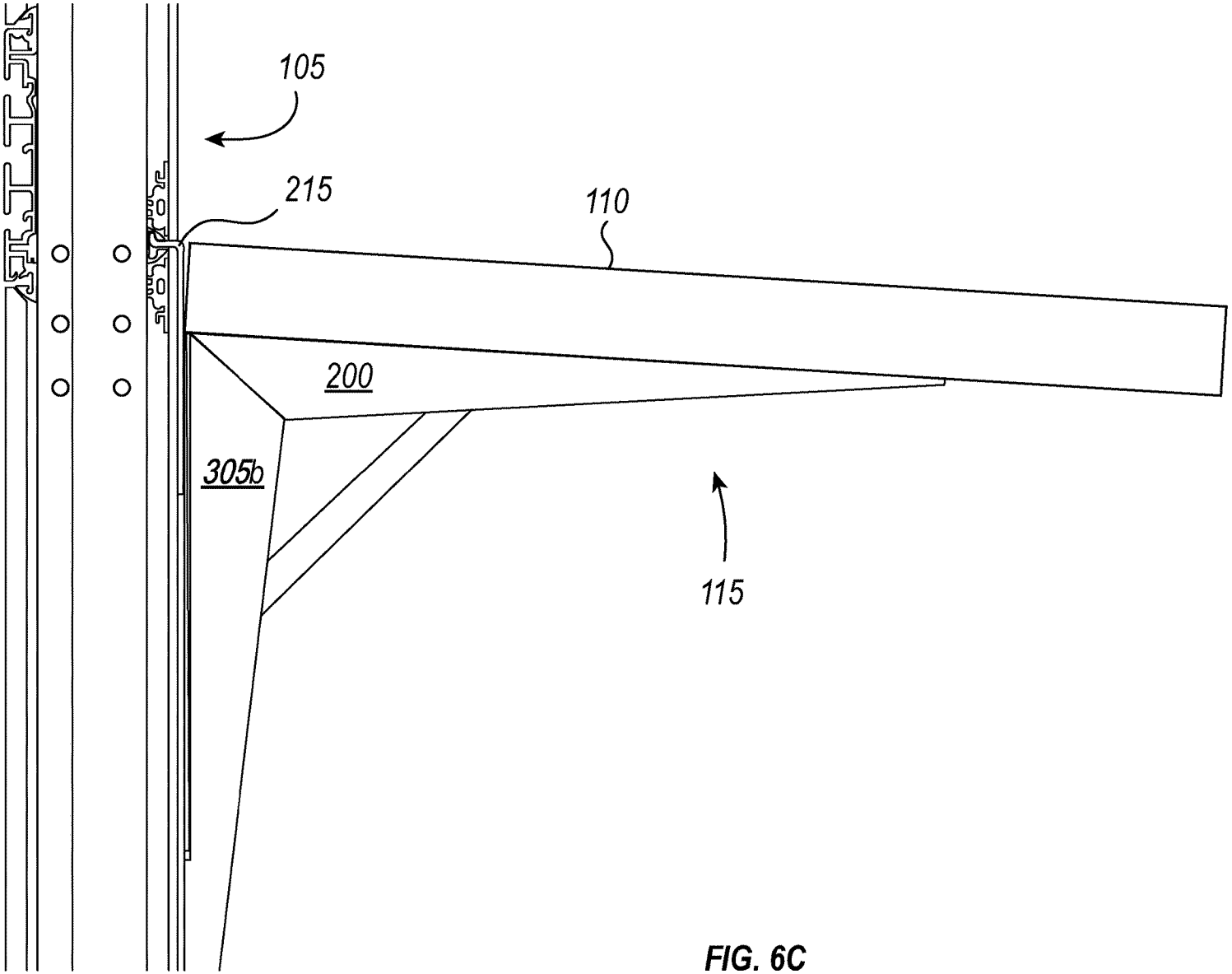
FIG. 6C illustrates an exemplary height adjusting and leveling worksurface cantilever angled downward and in a lowered height position.

FIG. 6A-6C illustrate various heights and leveled configurations of an exemplary height adjusting and leveling worksurface cantilever 115. FIG. 6A shows the height adjusting and leveling worksurface cantilever 115 angled at 90 degrees so the worksurface 110 is level when no weight is applied to the worksurface 110. Also, FIG. 6A shows the height adjusting and leveling worksurface cantilever 115 raised to the highest possible height. In at least one implementation, the range of height adjustment for the height adjusting and leveling worksurface cantilever 115 is 0 inches to about 15 inches. Alternatively, the range of height adjustment for the height adjusting and leveling worksurface cantilever can be in a range of 0 inches to about 8.5 inches. The hanger bracket 215 is also shown mounted within the modular wall system 105.

FIG. 6B shows the height adjusting and leveling worksurface cantilever 115 angled up to account for weight on the worksurface 110 or to compensate for the modular wall system 105 being non-vertical, or the modular wall system flexing to become non-vertical. In at least one implementation, the horizontal frame member 200 and attached worksurface 110 can be angled up in a range of 0 degrees to about 10 degrees. Alternatively, the horizontal frame member 200 and attached worksurface 110 can be angled up in a range of 0 degrees to about 5 degrees.

FIG. 6C shows the height adjusting and leveling worksurface cantilever 115 angled down. In at least one implementation, the horizontal frame member 200 and attached worksurface can be angled down in a range of 0 degrees to −5 degrees. Alternatively, the horizontal frame member 200 and attached worksurface can be angled down in a range of 0 degrees to about −3 degrees.

FIGS. 6A-6C also show how the gap between the horizontal frame member 200 and outer vertical frame member 305*b* (that exposes the inner vertical frame member 305*a*) increases as the height adjusting and leveling worksurface cantilever 115 is angled upward. The gap only disappears when the height adjusting and leveling worksurface cantilever 115 is angled downward to the lowest point, as shown in FIG. 6C.

FIGS. 6B and 6C both show the height adjusting and leveling worksurface cantilever 115 at the lowest possible height. As shown, the hanger bracket 215 remains fixed to the modular wall system 105, but the height adjusting and leveling worksurface cantilever 115 has been lowered relative to the fixed hanger bracket 215.

Figure 7:
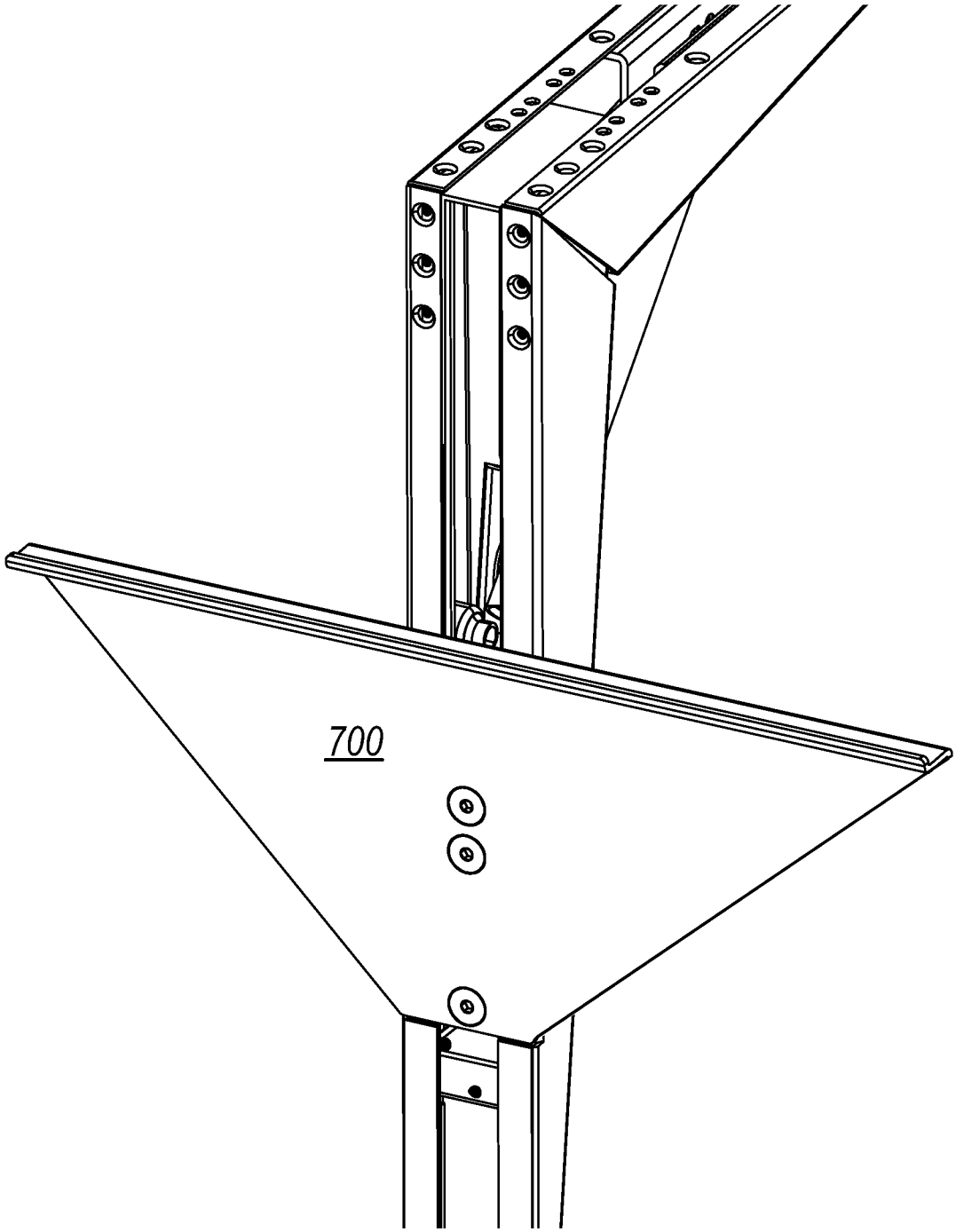
FIG. 7 illustrates an alternative hanger bracket for use with a central height adjusting and leveling worksurface cantilever in accordance with the present disclosure.

FIG. 7 shows an alternative hanger bracket 700 designed for use with a centrally mounted height adjusting and leveling worksurface cantilever having two separate worksurfaces attached thereon. As shown in FIG. 7, the hanger bracket 700 is larger than those shown in other figures, which helps reduce flex to accommodate the additional weight resultant from supporting a side of the two separate worksurfaces.

The foregoing features and mechanisms of the height adjusting and leveling worksurface cantilever allow an installer or user to correct for any downward angling of the cantilevered worksurface due to weight or due to a non-vertical mounting surface. Also, because the pivot point of the leveling mechanism is at the rear corner of the horizontal frame member, no gaps or fastening components become visible when the horizontal frame member is angled upward. Further, the height adjusting mechanism allows for continuous height adjustment of the height adjusting and leveling worksurface cantilever, even while the worksurface is supporting weight.

One skilled in the art will appreciate that neither the height adjusting and leveling worksurface cantilever nor the worksurface are limited to any specific composition material. For example, the height adjusting and leveling worksurface cantilever could be made from metal, wood, plastic, etc., or a mixture thereof. In at least one implementation, the height adjusting and leveling worksurface cantilever is made from 16-gauge steel. Similarly, the worksurface could be made from metal, wood, plastic, etc., or a mixture thereof.

Also, although the figures show exemplary the height adjusting and leveling worksurface cantilevers with that are height adjustable from the left side, one skilled in the art will appreciate that the positioning of the side socket head cap screw 220 is not limited to the placement on the left side. In at least one implementation, an installer or user uses both a left-handed and a right-handed height adjusting and leveling worksurface cantilever in a height adjusting and leveling worksurface cantilever system, wherein the side socket head cap screws 220 face inward and are therefore not as visible.

The present invention may be implemented in other specific forms without departing from its spirit or essential characteristics. The described implementations are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A height adjusting and leveling worksurface cantilever, comprising:

a horizontal frame member comprising a distal end and a proximal end;

a vertical frame member comprising a distal end and a proximal end; and a leveling mechanism comprising a turnbuckle rod that can adjust an angle of the horizontal frame member relative to the vertical frame member, wherein the angle of the horizontal frame member is adjusted from a pivot point located on a proximal corner of the height adjusting and leveling worksurface cantilever, the proximal corner being proximate to where the horizontal frame member connects with the vertical frame member; and a height adjusting mechanism comprising a threaded rod that can adjust a height of the height adjusting and leveling worksurface cantilever, relative to a hanger bracket configured to hang the height adjusting and leveling worksurface cantilever from a modular wall, the hanger bracket including a hook configured to cantilever from a recess in the modular wall, wherein the height adjusting mechanism is configured to adjust the height of the height adjusting and leveling worksurface cantilever by axially rotating a screw disposed in a top surface of the horizontal frame member.

2. The height adjusting and leveling worksurface cantilever of claim 1, wherein a worksurface is attached to the horizontal frame member and the leveling mechanism is configured to adjust an angle of the worksurface and horizontal frame member relative to the vertical frame member.

3. The height adjusting and leveling worksurface cantilever of claim 1, wherein the leveling mechanism is configured to adjust the angle of the horizontal frame member relative to the vertical frame member in a range of about −3 degrees to about 5 degrees.

4. The height adjusting and leveling worksurface cantilever of claim 1, wherein the height adjusting mechanism is configured to adjust the height of the height adjusting and leveling worksurface cantilevers relative to the hanger bracket in a range of 0 inches to about 8.5 inches.

5. The height adjusting and leveling worksurface cantilever of claim 1, wherein the pivot point is associated with a pivot spring bracket that extends from the proximal end of the horizontal frame member to the proximal end of the vertical frame member.

6. The height adjusting and leveling worksurface cantilever of claim 1, wherein:

the turnbuckle rod extends from a point between the distal end and the proximal end of the horizontal frame member to a point between the proximal end and the distal end of the vertical frame member;

the turnbuckle rod is secured to the horizontal frame member via a first turnbuckle threaded rod; and the turnbuckle rod is secured to the vertical frame member via a second turnbuckle threaded rod.

7. The height adjusting and leveling worksurface cantilever of claim 6, wherein the leveling mechanism is configured to adjust the angle of the horizontal frame member relative to the vertical frame member via axial rotation of the turnbuckle rod.

8. The height adjusting and leveling worksurface cantilever of claim 1, wherein the threaded rod extends through a tapped load plate that is reversibly secured to the hanger bracket.

9. The height adjusting and leveling worksurface cantilever of claim 1, wherein:

the threaded rod extends from the distal end of the vertical frame member to the proximal end of the vertical frame member;

the threaded rod is coupled to a top socket head cap screw disposed in a top surface of the proximal end of the horizontal frame member; and the height adjusting mechanism can adjust the height of the height adjusting and leveling worksurface cantilever relative to the hanger bracket via axial rotation of the top socket head cap screw.

10. The height adjusting and leveling worksurface cantilever of claim 1, further comprising a gearbox comprising a coupled first and second gear, wherein:

the threaded rod extends from the distal end of the vertical frame member to the proximal end of the vertical frame member;

the gearbox is disposed at a point between the distal end of the vertical frame member and the proximal end of the vertical frame member;

the first gear is coupled to a side socket head cap screw;

the second gear is coupled to the threaded rod; and the height adjusting mechanism is configured to adjust the height of the height adjusting and leveling worksurface cantilever relative to the hanger bracket via axial rotation of the side socket head cap screw.

11. The height adjusting and leveling worksurface cantilever of claim 1, wherein the hook of the hanger bracket is a hooking feature configured to be angled into a recess in the modular wall and hang the height adjusting and leveling worksurface cantilever from the recess in the modular wall using the hooking feature to engage the recess in the modular wall such that a combination of the recess, the hooking feature, and a weight of the height adjusting and leveling worksurface cantilever against the modular wall holds the height adjusting and leveling worksurface cantilever in position.

12. The height adjusting and leveling worksurface cantilever of claim 1, wherein the vertical frame member extends an entire length of the threaded rod, enclosing the threaded rod within the vertical frame member.

13. A height adjusting and leveling worksurface cantilever, comprising:

a leveling mechanism comprising a turnbuckle rod that is configured to adjust an angle of a horizontal frame member relative to a vertical frame member, wherein:

the angle of the horizontal frame member is adjusted from a pivot point located on a proximal corner of the height adjusting and leveling worksurface cantilever, the proximal corner being proximate to where the horizontal frame member connects with the vertical frame member;

the horizontal frame member comprises a distal end and a proximal end;

the vertical frame member comprises a distal end and a proximal end;

the turnbuckle rod extends from a point between the distal end and the proximal end of the horizontal frame member to a point between the proximal end and the distal end of the vertical frame member; and a height adjusting mechanism comprising a threaded rod that is configured to adjust a height of the height adjusting and leveling worksurface cantilever, relative to a hanger bracket configured to hang the height adjusting and leveling worksurface cantilever from a modular wall, wherein:

the threaded rod extends from the distal end of the vertical frame member to the proximal end of the vertical frame member, and the vertical frame member extends an entire length of the threaded rod;

the threaded rod is coupled to a top socket head cap screw disposed in a top surface of the proximal end of the horizontal frame member; and wherein the height adjusting mechanism is configured to adjust the height of the height adjusting and leveling worksurface cantilever relative to the hanger bracket via axial rotation of the top socket head cap screw.

14. The height adjusting and leveling worksurface cantilever of claim 13, wherein the leveling mechanism is configured to adjust the angle of the horizontal frame member relative to the vertical frame member via axial rotation of the turnbuckle rod.

15. The height adjusting and leveling worksurface cantilever of claim 13, further comprising a gearbox comprising a coupled first and second gear, wherein:

the gearbox is disposed at a point between the distal end of the vertical frame member and the proximal end of the vertical frame member;

the first gear is coupled to a side socket head cap screw;

the second gear is coupled to the threaded rod; and the height adjusting mechanism can adjust the height of the height adjusting and leveling worksurface cantilever relative to the hanger bracket via axial rotation of the side socket head cap screw.

16. A height adjusting and leveling worksurface cantilever system, the system comprising:

at least one worksurface; and at least two height adjusting and leveling worksurface cantilevers, the at least two height adjusting and leveling worksurface cantilevers comprising:

a leveling mechanism that comprises a turnbuckle rod configured to adjust an angle of the at least one worksurface relative to at least two vertical frame members via at least two horizontal frame members, wherein the angle of the at least one worksurface is adjusted from a pivot point located on a proximal corner of each of the at least two height adjusting and leveling worksurface cantilevers, the proximal corner being proximate to where respective of the at least two horizontal frame members connect with corresponding of the at least two vertical frame members; and a height adjusting mechanism that comprises a threaded rod configured to adjust a height of the at least one worksurface and the at least two height adjusting and leveling worksurface cantilevers relative to at least two hanger brackets that are configured to hang the height adjusting and leveling worksurface cantilever from a modular wall via a hook configured to cantilever from a recess in the modular wall, wherein the height adjusting mechanism is configured to adjust a height of the at least two height adjusting and leveling worksurface cantilevers by axially rotating a screw disposed in a top surface of at least one of the horizontal frame members.

17. The height adjusting and leveling worksurface cantilever system of claim 16, wherein the leveling mechanism is configured to adjust the angle of the at least one worksurface and the at least two horizontal frame members relative to the at least two vertical frame members in a range of about −3 degrees to about 5 degrees.

18. The height adjusting and leveling worksurface cantilever system of claim 16, wherein the height adjusting mechanism is configured to adjust the height of the at least one worksurface and the at least two height adjusting and leveling worksurface cantilevers relative to at least two hanger brackets in a range of 0 inches to about 8.5 inches.

19. The height adjusting and leveling worksurface cantilever system of claim 16, wherein the at least two hanger brackets are configured to be mounted to a modular wall system.

* * * * *